US005590773A

United States Patent [19]

Robinett

[11] Patent Number: 5,590,773

[45] Date of Patent: Jan. 7, 1997

[54] GOLF WET TOWEL CONTAINER

[76] Inventor: Gordon Robinett, 6 Bate Rd., Craryville, N.Y. 12521

[21] Appl. No.: 516,258

[22] Filed: Aug. 17, 1995

[51] Int. Cl.[6] ..... B65D 85/20

[52] U.S. Cl. ..... 206/315.1; 206/315.3; 206/315.2; 206/812

[58] Field of Search ..... 206/315.1, 315.2, 206/315.3, 315.5, 493, 494, 495, 812; 150/154, 159, 160; 15/209.1; 383/43, 88, 57, 92, 7, 8, 22

[56] References Cited

U.S. PATENT DOCUMENTS

| | | | |
|---|---|---|---|
| 518,574 | 4/1894 | Procter | 383/92 X |
| 2,791,255 | 5/1957 | Ogden | 206/315.2 X |
| 3,350,736 | 11/1967 | Frazelle et al. | 15/113 |
| 3,385,428 | 5/1968 | Kugler | 206/493 |
| 3,462,069 | 8/1969 | Suominen | 383/9 X |
| 3,596,824 | 8/1971 | Lehmacher | 383/9 X |
| 4,131,195 | 12/1978 | Worrell, Sr. | 206/812 X |
| 4,378,866 | 4/1983 | Pelavin | 190/52 |
| 4,383,563 | 5/1983 | Kirchhoff, Jr. | 206/315.2 |
| 4,428,477 | 1/1984 | Cristofolo | 206/812 X |
| 4,516,616 | 5/1985 | Fesler | 150/52 |
| 4,771,502 | 9/1988 | Trimble | 15/209 R |
| 4,911,292 | 3/1990 | Airey, Jr. | 206/315.3 |
| 4,953,603 | 9/1990 | Holden | 150/154 |
| 5,161,683 | 11/1992 | Smith | 206/315.1 |
| 5,372,414 | 12/1994 | Lamonakis et al. | 312/3 |
| 5,450,954 | 9/1995 | Dunn | 206/315.5 |

FOREIGN PATENT DOCUMENTS 83661 of 1954 Norway .

*Primary Examiner*—David T. Fidei
*Attorney, Agent, or Firm*—Heslin & Rothenberg, P.C.

[57] ABSTRACT

A wet towel container for maintaining a moist towel therein for use during golfing activities, includes an enclosure formed of a sheet of waterproof material. The sheet is generally rectangular in shape and has a first edge opposing a second edge and a third edge opposing a fourth edge. Preferably, the sheet is bent along its midline to form a first side of the enclosure. The sheet is bent along its midline such that a partial length of the first edge overlaps and is attached to another partial length of the first edge so as to form a second side of the enclosure, and that a partial length of the second edge overlaps and is attached to another partial length of the second edge so as to form a third side of the enclosure. The third edge and the fourth edge are adapted to form an opening along the golf wet towel container. The golf wet towel container also includes a connector for attaching the container to a selected object. The third and fourth edges are preferably bent so as to form a first flap and a second flap, respectively. Both first and second flaps may extend lengthwise along the fourth side of the container. Each flap may also include a channel extending therethrough. First flap abuts second flap to form the opening therebetween.

19 Claims, 2 Drawing Sheets

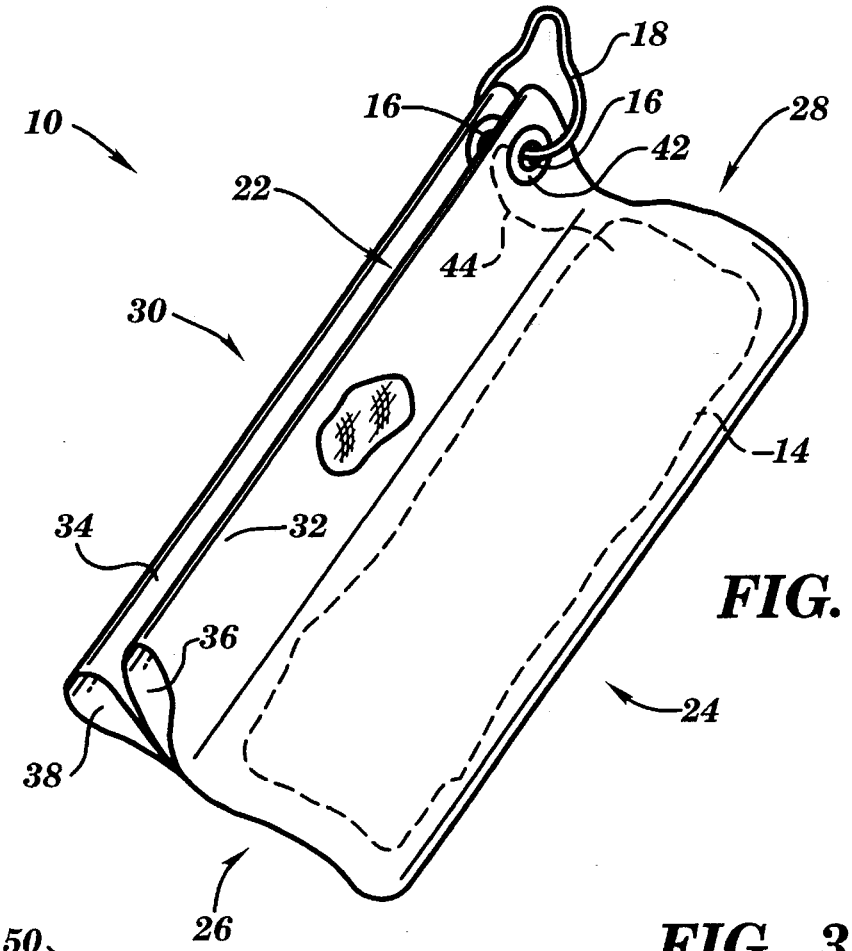
FIG. 2
FIG. 3
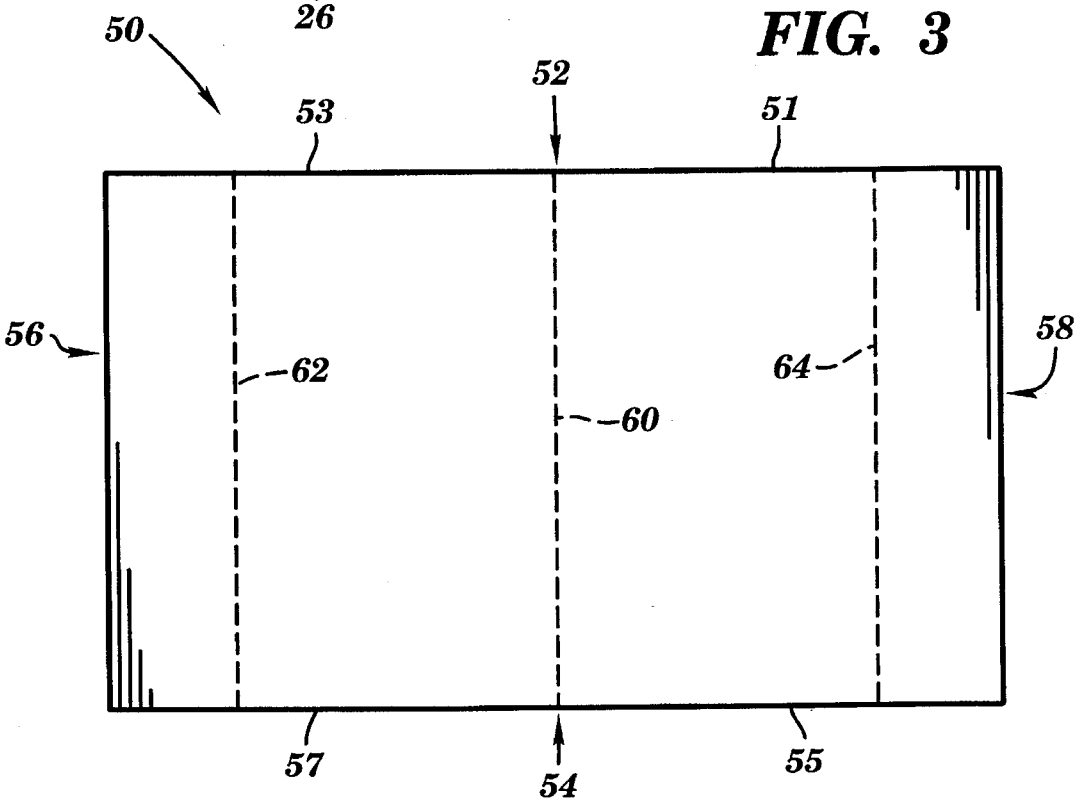

GOLF WET TOWEL CONTAINER

BACKGROUND OF THE INVENTION

1. Technical Field

The present invention generally relates to a container and assembly for maintaining a towel in a moist state. More particularly, the present invention relates to a container and an enclosed golf wet towel which may be attached to a selected object such as a golf cart or a golf bag to provide the user with easy access to the moist towel during golfing activities.

2. Background Information

During golfing activities, it is often desirable to have a moist or wet towel close at hand. Such a wet towel is desirable because often times it is necessary to clean the faces of golf clubs and other objects with a damp towel. By regularly cleaning the faces of golf clubs, a golfer's performance may be substantially improved. Furthermore, frequent cleaning extends the life of a golfer's clubs.

One problem faced by golfing enthusiasts, however, is the difficulty in maintaining a towel in a moist state throughout the entirety of a golf outing. This problem is further aggravated during hot and dry weather conditions. Also, the problem of keeping the towel moist is made even more difficult because golfing is often an all day event. Furthermore, in addition to the problem associated with keeping towels in a moist state, is the difficulty in providing a simple and easy to use container which has an easily accessible towel for use in cleaning the faces of golf clubs.

Thus, a need exists for a golf wet towel container which maintains a towel in a moist state for an extended period of time, notwithstanding hot and dry weather conditions. Furthermore, there is a need that this container provide easy access to the towel contained therein, thereby facilitating ease in cleaning the faces of golf clubs. The structure of the present invention contains a solution to the aforementioned problems.

SUMMARY OF THE INVENTION

Briefly, the present invention satisfies this need and overcomes the shortcomings of the prior art through the provision of a golf wet towel container for maintaining a moist towel therein for use during golfing activities, which includes an enclosure formed of a sheet of a substantially waterproof material. The sheet is generally rectangular in shape and has a first edge opposing a second edge and a third edge opposing a fourth edge. Preferably, the sheet is bent along its midline to form a first side of the enclosure. The sheet is bent along its midline such that a partial length of the first edge overlaps and is attached to another partial length of the first edge so as to form a second side of the enclosure, and that a partial length of the second edge overlaps and is attached to another partial length of the second edge so as to form a third side of the enclosure. The third edge and the fourth edge are adapted to form an opening along the golf wet container. The golf wet towel container also includes a connector for attaching the container to a selected object.

The third and fourth edges are preferably bent so as to form a first flap and a second flap, respectively. Both first and second flaps may extend lengthwise along the fourth side of the container. Each flap may also include a channel extending lengthwise therethrough. First flap abuts second flap to form the opening therebetween. The golf wet towel container may also include an aperture which passes through both first and second flaps for facilitating attachment of the container to a selected object.

In another embodiment, a golf wet towel container for maintaining a moist towel therein for use during golfing activities includes: an enclosure formed of water-proof material adapted for maintaining the towel in a moist state therein; the enclosure has an opening along a side thereof; the opening is defined by a first flap adjacent to a second flap, the first flap having a first channel extending therethrough and the second flap having a second channel extending therethrough; and a connector for attaching the golf wet towel container to a selected object.

It is therefore a primary object of the present invention to provide a protective container for maintaining a towel in a wet state therein.

It is another object of the present invention to provide a simple and easy to use protective container and enclosed wet towel for use in outdoor sporting activities.

It is still another object of the present invention to provide a protective container for holding and maintaining a wet towel therein so that the wet towel is readily available for use during outdoor sporting activities.

It is yet another object of the present invention to provide a protective container for maintaining a towel in a wet and moist condition therein for a long period of time.

It is still another object of the present invention to provide a protective container for holding and maintaining a towel in a wet condition which is extremely simple and cost effective to manufacture.

BRIEF DESCRIPTION OF THE DRAWINGS

The subject matter which is regarded as the present invention is particularly pointed out and distinctly claimed in the concluding portion of the specification. The invention, however, both as to organization and method of practice, together with the further objects and advantages thereof, may be best understood by reference to the following detailed description taken in conjunction with the accompanying drawings in which:

FIG. 2 is an enlarged perspective view of the golf wet towel container shown in FIG. 1, having a towel inserted therein.

FIG. 3 is a plan view of the golf wet towel container of the present invention shown generally as a rectangular sheet prior to assembly thereof.

DETAILED DESCRIPTION OF THE PREFERRED EMBODIMENTS

Figure 1:
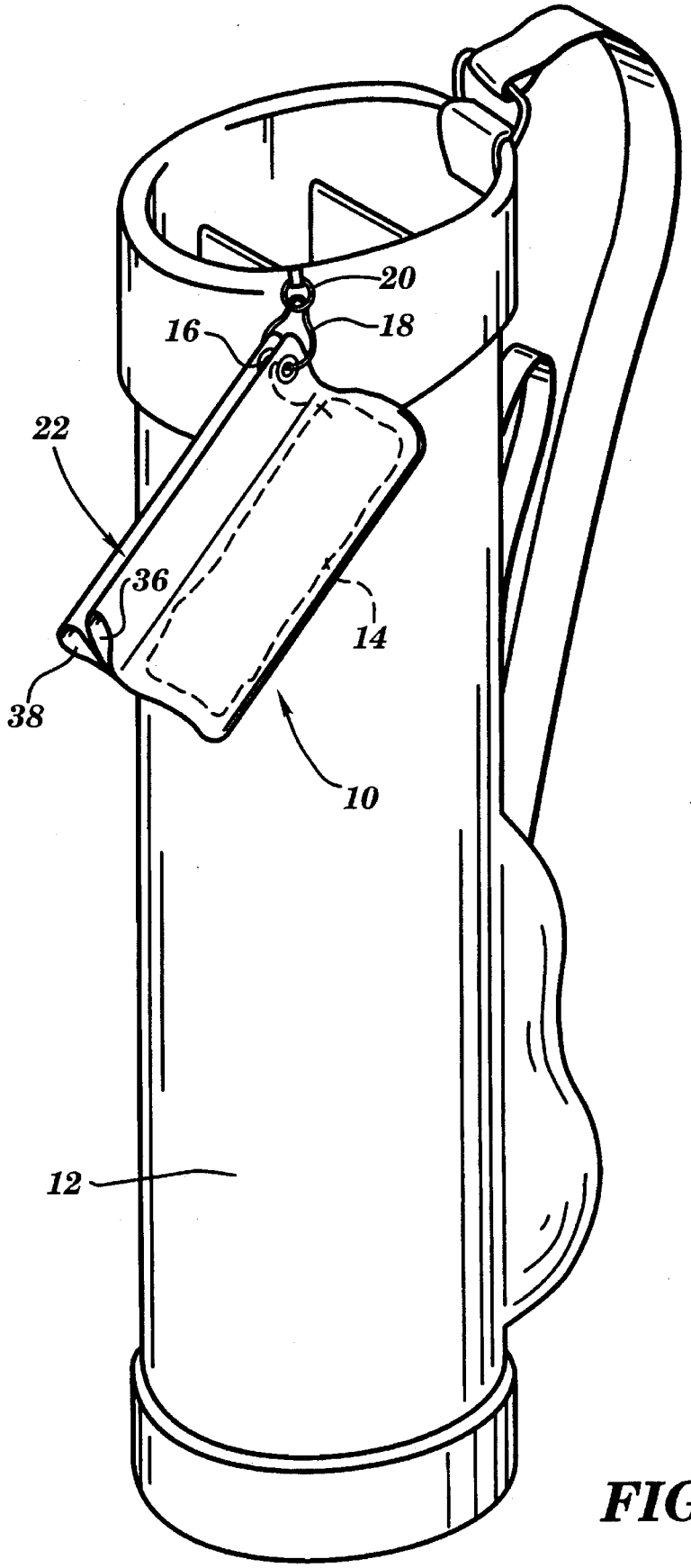
FIG. 1 is a perspective view of a golf wet towel container made in accordance with the principles of the present invention, shown attached to a conventional golf bag.

It will be readily apparent that the components of the present invention, as generally described and illustrated in the figures, could be arranged and designed in a wide variety of different configurations. Thus, the following detailed description of the presently preferred embodiments of the golf wet towel container of the present invention, as represented in FIGS. 1–3, is not intended to limit the scope of the invention, as claimed, but is merely representative of the presently preferred embodiments of the invention. The presently preferred embodiments of the invention will be best understood by reference to the drawings, where like parts are designated with like numerals.

In reference to the drawings, and more particularly to FIG. 1. there is shown in accordance with the principles of the present invention, one embodiment of a golf wet towel container 10, as attached to a conventional golf bag 12. A towel 14 may be easily inserted into an enclosure of golf wet towel container 10. Golf wet towel container 10 may include a means for fastening golf wet towel container 10 to golf bag 12. An aperture 16 extends through container 10 for facilitating the insertion of a clasp 18 or other connector therethrough so that golf wet towel container 10 can be easily attached to a standard ring 20 of golf bag 12.

An opening 22 extends lengthwise along one side of golf wet towel container 10 for easy access to towel 14. In order to keep towel 14 in a moist state inside the enclosure of container 10, water or another fluid may be introduced therein. Because wet towel container 10 has been designed for cleaning the faces of golf clubs or other objects during outdoor activities like golfing, a cleansing agent may be introduced into the enclosure. Additionally, because of the configuration of container 10, opening 22 typically remains in a closed position, thereby retaining any fluid contained therein, including the retention of towel 14. While opening 10 is configured to remain closed, the design of the present invention is such that opening 22 may be simply and easily spread for the insertion and removal of towel 14. This configuration further simplifies the introduction and removal of a fluid into and from container 10.

As shown in greater detail FIG. 2, golf wet towel container 10 is preferably rectangular in shape. However, it should be understood that other shapes may also be desirable for the golf wet towel container of the present invention, including, for example, circular and triangular configurations. In the preferred embodiment, however, golf wet towel container 10 is generally rectangular in shape. Golf wet towel container 10 includes four sides, a first side 24, a second side 26, a third side 28, and a fourth side 30. Golf wet towel container 10 includes an opening 22 which leads into the internal compartment or enclosure which holds towel 14 therein. The internal enclosure also retains a fluid for maintaining a moist environment for towel 14. Both second side 26 and third side 28 are sealed, thereby retaining the fluid therein. Opening 22 may extend lengthwise along fourth side 30. Towel 14 may be easily inserted through opening 22 and into the enclosure of golf wet towel container 10.

Two flaps, a first flap 32 and a second flap 34, may extend lengthwise along fourth side 30 of container 10. Each flap forms a channel extending lengthwise along the fourth side 30, i.e., a first channel 36 corresponding to first flap 32 and a second channel 38 corresponding to second flap 34. Each channel is preferably an open air channel, and therefore, each channel preferably resembles an elongated hollow tubular member. While in the preferred embodiment flaps 32 and 34 have open ends, it should be noted that the ends may alternatively be sealed. Also, each channel may be filled with a material, such as foam or the like. First flap 32 and second flap 34 are aligned adjacent to one another, and the orientation of the flaps, including the width and bulk of the flaps, naturally forces first flap 32 and second flap 34 to abut one another, thereby forcing opening 22 to remain in a closed position. As stated above, this configuration also facilitates the retention of both the fluid and towel 14 in container 10. This configuration also facilitates easy access to wet towel 14 when needed for cleaning the faces of golf clubs and the like. In the event that towel 14 needs to be accessed, abutting first flap 32 and second flap 34 may be easily separated by simply inserting one's hand into the enclosure of golf wet towel container 10.

Each flap 32, 34 preferably includes aperture 16 formed therethrough. Each aperture 16 is preferably alignable to one another and may include a reinforcing grommet 42. In order to facilitate attachment of golf wet towel container 10 to a selected object, like golf bag 12, clasp 18 may be inserted through each aperture 16. Also, in maintaining the position of towel 14 in the enclosure of golf wet towel container 10, a strand 44 may be fixedly secured to towel 14 and removably attached to clasp 18. Strand 44 therefore insures the user of golf wet towel container 10 simple and easy access to towel 14. Alternatively, towel 14 may include a hole (not shown) and reinforcing grommet (not shown) so that clasp 18 may be inserted therethrough.

In reference now to FIG. 3, golf wet towel container 10 is preferably derived from a flat sheet 50, generally rectangular in shape. Flat sheet 50 may be fabricated from any known material having good waterproof characteristics for facilitating water retention inside golf wet towel container 10. The material selected should also have high durability. From the standpoint of cost and ease of manufacturing, plastics are preferable. However, other materials, including waterproof fabrics may be employed. For ease of handling and operation, it is also desirable for golf wet towel container 10 to be fabricated from a pliable material. The material selected for golf wet towel container 10 should also be aesthetically pleasing.

Flat sheet 50, from which golf wet towel container is preferably fabricated, includes a first edge 52 opposing a second edge 54, and a third edge 56 opposing a fourth edge 58. In constructing golf wet towel container 10, sheet 50 may be bent about a line 60 so as to form first side 24. As used throughout this specification, the term bent is meant that sheet 50 is curved or rounded about line 60 and not creased about line 60. Alternatively, however, sheet 50 may be creased about line 60.

Preferably, line 60 is a mid-line of sheet 50, located equidistant from third edge 56 and fourth edge 58. By bending sheet 50 about line 60, a partial length 51 of first edge 52 may overlap and be attached to another partial length 53 of first edge 52 so as to form second side 26 of golf wet towel container 10. Likewise, a partial length 55 of second edge 54 may overlap and be attached to another partial length 57 of second edge 54 so as to form third side 28 of golf wet towel container 10. The preferred means of attaching the edges together is by heat sealing. However, it should be understood that any means of attachment, including chemical bonding or stitching, may be employed. There are also times where it may be desirable to utilize more than one method of attachment.

In forming flaps 32 and 34 of golf wet towel container 10, sheet 50 may be curved or bent along two lines extending parallel to fourth side 30, i.e., first line 62 corresponding to first flap 32 and second line 64 corresponding to second flap 34. Preferably, sheet 50 is not creased along lines 62, and 64. Instead, like line 60, sheet 50 should be rounded or curved along lines 62 and 64 so as to facilitate the fullness or bulk of flap 32 and 34.

Third edge 56 may be attached to the inner face of sheet 50 so as to form first flap 32. Likewise, fourth edge 58 may be attached to the inner face of sheet 50 so as to form second flap 34. Any known means of attaching the edges to the inner face of sheet 50 may be employed, but heat sealing is the preferred method.

Also, while several aspects of the present invention have been described and depicted herein, alternative aspects may be effected by those skilled in the art to accomplish the same objectives. For example, while a rectangular configuration is preferred, other shapes and configurations are equally acceptable. Accordingly, it is intended by the appended claims to cover all such alternative aspects as fall within the true spirit and scope of the invention.

What is claimed:

1. A golf wet towel container for maintaining a moist towel therein for use during golfing activities, said golf wet towel container comprising:

an enclosure formed of a sheet of substantially waterproof material adapted for maintaining said towel in a moist state therein, said sheet being generally rectangular in shape and having a first edge opposing a second edge and a third edge opposing a fourth edge;

said sheet being bent along a line to form a first side of said enclosure, said sheet being bent such that a partial length of said first edge overlaps and is attached to another partial length of said first edge so as to form a second side of said enclosure, and that a partial length of said second edge overlaps and is attached to another partial length of said second edge so as to form a third side of said enclosure;

said third edge and said fourth edge being adapted to form an opening along said golf wet towel container for access to said enclosure;

a towel attached to said container; and a connector for attaching said golf wet towel container to a golf bag.

2. The golf wet towel container of claim 1, wherein said sheet is bent so as to form a first flap, said first flap being sealed to said sheet.

3. The golf wet towel container of claim 2, wherein said first flap extends lengthwise along a fourth side and forms a channel extending from said second side to said third side.

4. The golf wet towel container of claim 3, wherein said sheet is bent so as to form a second flap, said second flap being sealed to said sheet.

5. The golf wet towel container of claim 4, wherein said second flap extends lengthwise along said fourth side and forms a channel extending from said second side to said third side.

6. The golf wet towel container of claim 5, wherein said first flap abuts said second flap.

7. The golf wet towel container of claim 1, wherein an aperture passes through said sheet for facilitating attachment of said golf wet towel container to said selected object.

8. The golf wet towel container of claim 5, wherein a first aperture passes through said first flap and a second aperture passes through said second flap, said first and second apertures being alignable to one another.

9. The golf wet towel container of claim 8, wherein said first and second apertures are each fitted with a grommet.

10. The golf wet tower container of claim 9, wherein a clasp is inserted through said grommets.

11. The golf wet towel container of claim 10, wherein said towel is attached to said clasp.

12. A golf wet towel container for maintaining a moist towel therein for use during golfing activities, said golf wet towel container comprising:

an enclosure formed of substantially water-proof material adapted for maintaining said towel in a moist state therein;

said enclosure having an opening along a side thereof;

said opening being defined by a first flap adjacent to a second flap, said first flap having a first channel extending therethrough and said second flap having a second channel extending therethrough;

a towel attached to said container; and a connector for attaching said golf wet towel container to a golf bag.

13. The golf wet towel container of claim 12, wherein said first flap is formed by a first bend in said material along said side and towards said opening and said second flap is formed by a second bend in said material along said side and towards said opening.

14. The golf wet towel container of claim 13, wherein said first and second channels are hollow.

15. The golf wet towel container of claim 14, wherein said first and second channels are filled with a material.

16. The golf wet towel container of claim 12, wherein a first aperture passes through said first flap and a second aperture passes through said second flap, said first and second apertures being alignable to one another.

17. The golf wet towel container of claim 16, wherein each of said first and second apertures are fitted with a grommet.

18. The golf wet towel container of claim 16, wherein a clasp is inserted through said first and second apertures.

19. The golf wet towel container of claim 18, further comprising a towel inserted in said enclosure, said towel being attached to said clasp.

* * * * *